United States Patent [19]

Chriswell et al.

[11] Patent Number: 4,859,212

[45] Date of Patent: Aug. 22, 1989

[54] CHEMICAL CLEANING OF COAL BY MOLTEN CAUSTIC LEACHING AFTER PRETREATMENT BY LOW-TEMPERATURE DEVOLATILIZATION

[75] Inventors: Colin D. Chriswell, Slater, Iowa; Surender M. Kaushik, Socorro, N. Mex.; Navin D. Shah, Houston, Tex.; Richard Markuszewski, Ames, Iowa

[73] Assignee: Iowa State University Research Foundation, Inc., Ames, Iowa

[21] Appl. No.: 244,991

[22] Filed: Sep. 15, 1988

[51] Int. Cl.[4] ..... C10L 5/00

[52] U.S. Cl. ..... 44/622; 423/461

[58] Field of Search ..... 44/622, 626; 201/17; 423/460, 461

[56] References Cited

U.S. PATENT DOCUMENTS

| | | | |
|---|---|---|---|
| 28,543 | 5/1860 | Nock | 201/17 |
| 3,759,673 | 9/1973 | Whitten et al. | 44/1 R |
| 4,055,400 | 10/1977 | Stambaugh et al. | 44/1 R |
| 4,152,120 | 5/1979 | Zavitsanos et al. | 44/1 R |
| 4,384,536 | 5/1983 | Biswas | 110/342 |
| 4,479,804 | 10/1984 | Chen et al. | 44/1 SR |
| 4,497,636 | 2/1985 | Aida et al. | 44/622 |
| 4,545,891 | 10/1985 | Meyers et al. | 208/11 R |
| 4,661,118 | 4/1987 | Thorpe et al. | 44/622 |

*Primary Examiner*—Carl F. Dees

*Attorney, Agent, or Firm*—Zarley, McKee, Thomte, Voorhees & Sease

[57] ABSTRACT

Pretreatment of coal by devolatization at temperatures ranging from about 420° C. to about 450° C. for from about 10 minutes to about 30 minutes before leaching with molten caustic leads to a significant reduction in carbonate formation, greatly reducing the cost of cleaning coal on a per ton basis.

21 Claims, No Drawings

CHEMICAL CLEANING OF COAL BY MOLTEN CAUSTIC LEACHING AFTER PRETREATMENT BY LOW-TEMPERATURE DEVOLATILIZATION

BACKGROUND OF THE INVENTION

Ever stricter environmental standards for sulfur dioxide and particle emission controls during the combustion of coal have created a need for efficient cleaning of coal. In addition, coal with extremely low levels of sulfur and ash could be used as a direct replacement for imported petroleum in many applications. Over 60% of the coal mined in the eastern United States is presently cleaned at the mine site; however, many cleaning processes typically reduce only the ash content of the coal in order to decrease transportation costs and provide a consistent product. The commonly used washing procedures decrease pyritic sulfur levels only moderately, but organic sulfur is unaffected. However, deeper physical cleaning of coal with dense media, for example, can reduce pyritic sulfur levels by a significant amount; but organic sulfur, which generally comprises about half of the sulfur in coal, is not touched even by the most efficient physical cleaning. Thus, to obtain very low levels of sulfur and ash-forming minerals in coal requires chemical cleaning.

Molten caustic leaching (MCL) is an advanced chemical cleaning process for the removal of over 90% of the sulfur and ash from coal, see Meyers, U.S. Pat. No. 4,545,891 issued Oct. 8, 1985. However, during molten caustic leaching a significant fraction of the caustic is converted to carbonate by reaction with carbon from the coal and with oxygen from various sources. Recent tests have shown that a significant source of the oxygen is from the coal itself.

Carbonate formation is detrimental because: (1) caustic is an expensive reagent and carbonate formation leads to its consumption; (2) carbon is the main energy-containing constituent of coal and carbonate formation leads to its consumption; and, (3) carbonate present in spent caustic causes significant difficulties during reprocessing, e.g., it precipitates during countercurrent washing. In short, conversion of caustic to carbonate increases the expense of coal cleaning. For example, when one ton of coal is cleaned with two tons of caustic, each 1% of caustic converted to carbonate adds somewhere between $2.00 and $4.00 to the cleaning costs.

Nevertheless, in spite of the increased cost and the problems attendant with carbonate formation, molten caustic leaching has been demonstrated to be able to reduce ash levels in coal by more than 95% and sulfur levels by as much as 90%. This is the only chemical cleaning process at an advanced stage of development that can also reduce organic sulfur levels by a significant amount. In the MCL process the feed coal is usually physically pre-cleaned before MCL to reduce its mineral content and thereby reduce caustic consumption during MCL.

The coal is mixed with caustic and heated for 1–3 hours at 350° C. to 400° C. Various ratios of caustic to coal have been tried, but about 2 parts caustic to 1 part coal are typically used in unstirred leaching reactors. The caustic can be either NaOH alone or 1:1 mixtures (by wt.) of NaOH and KOH. During the MCL treatment, ash-forming minerals are rapidly converted to soluble salts, while organic sulfur compounds react somewhat more slowly. After leaching, the coal-caustic mixture is washed with water to remove the soluble salts and then with dilute acid to remove ionically bound alkali metals and base-insoluble species such as iron hydroxides. The coal is then finally washed with water to remove any residual acid.

A countercurrent washing procedure may be used for the water washing of the coal-caustic mixture and for the acid washing step or concurrent washings may be used. Countercurrent washing is more efficient.

During the MCL process, various by-products are formed. For example, carbonate is formed by reaction of coal and caustic with some source of oxygen. Volatile organic liquids and gases are released from the coal, while water-soluble organic materials referred to as humic acids are dissolved in the caustic. The liquids and gases are recoverable as a potential source of fuel or for other higher value uses. The humic acids are not readily recoverable form spent caustic solutions, but at the present stages of development of the MCL process, the levels appear to be too low to have significant effects on the overall process.

However, as earlier explained, the production of carbonate during MCL processing is a significant detrimental factor. Formation of carbonate obviously results in the loss of carbon from the coal and in the excessive consumption of caustic, which must be subsequently regenerated by liming. In addition, carbonate is not very soluble in 50% caustic solutions produced from countercurrent washing of coal. Thus, carbonate in excess of solubility in the spent caustic is carried with the coal to a point where it can build up until it finally clogs the filters and brings, for example, the countercurrent washing to a halt.

It is a primary objective of the present invention to develop a process suitable for pretreating the coal prior to molten caustic leaching to decrease carbonate formation during the leaching process.

Another objective of the present invention is to develop an improved, molten caustic leaching process which cleans coal without the attendant difficulties of formation of significant amounts of carbonate.

Another objective of the present invention is to reduce cleaning costs of coal in processes of molten caustic leaching.

The method and manner of accomplishing each of the above objectives will become apparent from the detailed description of the invention which followed hereinafter.

SUMMARY OF THE INVENTION

An improved process of molten caustic leaching which minimizes carbonate formation, with the improvement comprising a pretreatment of the coal at temperatures from about 400° C. to about 450° C. for a time sufficient to remove oxygen-containing compounds from the coal, and thereby minimize the opportunity for carbonate formation.

DETAILED DESCRIPTION OF THE INVENTION

In accordance with the process of this invention, it has been discovered that if coal is pretreated by low devolatilization in a temperature range of from about 410° C. to about 450° C. for a time sufficient to remove oxygen-containing compounds from the coal, it minimizes the carbonate formation in subsequent molten caustic leaching processes. Devolatilization is understood to mean the removal of volatile components by the application of heat and/or vacuum.

The preferred temperature range is from about 420° C. to about 450° C. The time of the preheating can vary from about 10 minutes to about 1 hour, but is most preferably from about 15 minutes to about 30 minutes.

In the process it is most preferred that the preheating is in a sealed reactor vessel, purged of oxygen. Purging may be accomplished by any inert gas, including steam, but preferably by an inexpensive gas such as nitrogen.

When the pretreatment process of low temperature devolatilization of this invention is practiced, it leads to a reduction in carbonate formation from approximately 35% down to approximately 25%. Pretreatment when combined with rigorous exclusion of air in the preferred process of a sealed reactor vessel leads to a total reduction in carbonate formation of about 70% (i.e., down to about 10% to 15%).

The following examples are offered to further illustrate the process of this invention.

EXAMPLES

Three different coals were used: an Illinois No. 6, a Pittsburgh No. 8, and a Kentucky No. 11. Each of these coals had been physically precleaned at the mine site and was ground to minus 50 mesh for the MCL experiments. Analysis of the cleaned and sized coals used are given in Table I. Leachings were performed with sodium hydroxide or with equal weight mixtures of NaOH and KOH. These were ground to a fine powder in an Oster blender before use. Sizing of the caustic was not performed because of its extreme hygroscopicity, but visually it appeared to be about 100 mesh. Analyses of the caustics used are also presented in Table I. All other chemicals used were of ACS reagent quality.

TABLE I

Characteristics of Coals (Ground to −50 Mesh) And Caustics Used in the Molten Caustic Leaching Experiment

| | Coal | | |
|---|---|---|---|
| | Pittsburgh No. 8 | Illinois No. 6 | Kentucky No. 11 |
| Moisture | 2.8% | 7.8% | 3.3% |
| Ash | 9.8% | 10.1% | 10.2% |
| Total Sulfur | 4.21% | 3.77% | 3.17% |
| Pyritic Sulfur | 1.35% | 1.03% | 0.96% |
| Sulfate Sulfur | 0.05% | 0.12% | 0.46% |
| Organic Sulfur | 2.81% | 2.62% | 1.75% |
| Heating Value, Btu/lb | 12,750 | 11.799 | 13,213 |
| | Caustic(MOH) | | |
| | NaOH | KOH | 1:1 NaOH—KOH (by wt.) |
| Moisture | 1.5% | 12.3% | 6.9% |
| Carbonate (as $M_2CO_3$) | 0.4% | 0.5% | 0.45% |
| Assay for MOH | 98.1% | 87.2% | 92.7% |

The samples of coal and caustic were individually weighed into an empty caustic reagent bottle; the mixture shaken well and then transferred into the reactor crucible. In leachings with the open crucible, the crucible was lowered into the well of the preheated tube furnace, a nitrogen inlet probe placed into the crucible above the level of the coal caustic mixture, and a thermocouple probe placed in the coal-caustic mixture. The nitrogen flow rate was adjusted to 300 ml/min, and the temperature of the coal-caustic mixture was monitored until it reached the desired leaching temperature, e.g. 390° C. Approximately 45 minutes was required for the mixture to reach operating temperature, which was then maintained for the desired reaction time, generally two hours. At the conclusion of the reaction time, the crucible was removed from the reactor, and the coal-caustic mixture was then processed as described.

In MCL studies with the sealed reactor crucible, coal and caustic were introduced into the reactor as described above; the reactor was then sealed and the purge gas flow commenced at 300 ml/min. Samples of the gases exiting from the reactor were analyzed; and when the oxygen levels in those gases reached undetectable levels (usually less than 0.1%), the crucible was introduced into the furnace. The reaction was then allowed to proceed as described above. At the conclusion of the reaction time, the crucible was immersed in a vat of water, with the purge gas flow continuing, and cooled until the coal-caustic mixture reached room temperature.

After the MCL treatment, approximately 300 ml of water was added to the coal-caustic mixtures in the reactor crucibles and the resulting slurry stirred until the caustic appeared to be dissolved. Although this mixture was not heated, the heat of solution of the caustic rapidly raised the temperature to boiling. The slurry was poured from the crucible, and the crucible was washed out with an additional 200 ml of boiling water. The 500 ml of slurry was vacuum-filtered through Whatman No. 41 filter paper in a Buchner funnel, and the coal remaining on the filter paper was washed with an additional 500 ml of boiling water. The filtrates were combined and the volume was diluted to exactly one liter and retained for subsequent analyses. The coal cake was then slurried with 200 ml of hot 10% $H_2SO_4$, the mixture was filtered, and the coal on the filter paper washed with an additional 800 ml of boiling water. Subsequently, the coal was washed with 4 liters of hot water to ensure complete acid removal. The coal was dried at 110° C. for about 16 hours, weighed and retained for analysis.

Sulfide levels were determined in aliquots of the spent caustic solutions by acidification to convert the sulfide to $H_2S$, purging with nitrogen to expel the $H_2S$, and determination of the $H_2S$ using a modified Drager tube procedure. Levels of hydroxide and carbonate were determined in aliquots of the spent caustic solution by potentiometric titration, and carbonate levels were corrected for the co-titration of the sulfide present. Ash, sulfur, and heating value were determined on cleaned coals using ASTM procedures. Gases evolved during the molten caustic leaching and the low-temperature devolatilization of coal were analyzed by gas chromatography using a silicalite-packed column and procedures described previously.

For the pretreatment of the invention, coal samples were devolatilized by heating in the sealed reactor crucible under a nitrogen purge. As with the MCL procedures, weighed coal was introduced into the crucible, the crucible was sealed, and the gas flow was started. Heating commenced when oxygen was completely absent in the vented gas and proceeded until the desired temperature (typically 420° C.) was reached; this temperature was maintained for the desired interval (typically 15 minutes). The reactor was then cooled to room temperature by quenching in a water bath, with nitrogen purge continuing. The reactor was then opened and caustic was added for subsequent MCL experiments as discussed earlier. During preheating, the coal was agglomerated into one piece, and it was necessary to break it down into coal particles of about minus ¼ inch before adding caustic.

The effects of devolatilization pretreatment of coal are shown in Table II below. With all combinations studied, pretreatment reduced the formation of carbonate between 30% and 40%. This is considered a significant reduction in carbonate that would justify addition of a step to the overall MCL process. These data also indicate a higher conversion to carbonate for KOH-NaOH mixtures than for NaOH alone. If, however, conversion to carbonate is calculated on the basis of coal carbon going to carbonate carbon, there is no significant difference between the use of NaOH alone and NaOH-KOH mixtures. The average percent of coal carbon going to carbonate carbon for NaOH and NaOH-KOH runs with pretrated coals are 5.1 and 4.9, repsectively. The larger effect on caustic conversion merely reflects the higher formula weight for KOH than for NaOH. There are obvious differences in the conversion of caustic to carbonate among the different coals studied, but these differences are small compared with the effects of devolatilization.

TABLE II

Effects of Pretreating* of Coal on the Conversion of Caustic to Carbonate

| | % MOH→$M_2CO_3$ | | | |
|---|---|---|---|---|
| | NaOH Leaching | | NaOH—KOH Leaching | |
| Coal | Pre-treated | Unpre-treated | Pretreated | Unpre-treated |
| Illinois No. 6 | 14.2 | 21.0 | 19.3 | 29.1 |
| Illinois No. 6** | 12.4 | 19.5 | 18.6 | 25.1 |
| Pittsburgh No. 8 | 11.5 | 19.3 | 17.3 | 25.6 |
| Pittsburgh No. 8** | 10.2 | 19.7 | 17.5 | 23.5 |
| Kentucky No. 11 | 13.5 | 20.8 | 21.6 | 32.9 |
| Kentucky No. 11** | 13.6 | 21.4 | 21.6 | 29.9 |
| Average | 12.6 | 20.3 | 19.6 | 27.6 |

*Coal pretreated by heating at 420° C. for 15 minutes.
**Duplicate runs under identical conditions.

Pretreated and unpretreated coals had similar excellent ash and sulfur removals when only NaOH was used as the molten caustic leachant. However, coals which were devolatilized before MCL had heating values averaging about 10% greater than those of non-devolatilized coals. When NaOH-KOH mixtures were used, pretreating once again yielded coals with higher heating values, but these coals also had lower ash removals. The ash removals for pretreated and unpretreated were comparable with the Illinois coal, but considerably different with the Pittsburgh and Kentucky coals. These findings were confirmed with replicate runs. No satisfactory explanation for why devolatilization followed by molten caustic leaching of Pittsburgh and Kentucky coals with NaOH-KOH would be less efficient in removing ash.

These experiments demonstrate that extremely clean coals can be prepared by MCL, even when additional steps are introduced, primarily for suppression of carbonate formation. Carbonate formation can be suppressed by rigorous exclusion of air from reactor crucibles at all times when the coal or coalcaustic mixtures are above ambient temperatures. Carbonate formation can be further suppressed by the pretreatment of devolatization of coal prior to MCL. Devolatization of coal prior to MCL has no adverse effects on the quality of coal produced and results in a higher energy content coal. It therefore can be seen that the invention accomplishes at least all of the stated objectives for the invention.

What is claimed is:

1. In the molten caustic leaching process for removal of sulfur and ash from coal, the improvement comprising:

preheating the coal at a temperature of from about 400° C. to about 450° C. for a time sufficient to remove oxygen-containing compounds from the coal and thereby minimize carbonate formation in molten caustic leaching process.

2. The process of claim 1 wherein the preheating temperature is from about 420° C. to about 450° C.

3. The process of claim 1 wherein preheating occurs for from about ten minutes to about one hour.

4. The process of claim 3 wherein preheating is for from about 15 minutes to about 30 minutes.

5. The process of claim 1 wherein pretreating is in a sealed reactor vessel purged of oxygen.

6. The process of claim 5 wherein purging is inert gas purging.

7. The process of claim 6 wherein the inert gas purge is a nitrogen purge.

8. The process of claim 6 wherein the inert gas purge is a steam purge.

9. An improved process of molten caustic leaching, comprising:

(a) pretreating the coal at a temperature of from about 400° C. to about 450° C. for a time sufficient to remove oxygen-containing compounds from the coal and thereby minimize opportunity for carbonate formation; and thereafter, (b) mixing the preheated coal with caustic for from about 1.0 hours to about 3.0 hours at a temperature of from about 350° C. to about 400° C.;

(c) washing the molten caustic treated coal with water to remove water soluble salts;

(d) washing the water-washed coal with dilute acid to remove ionically bound alkali metals and base insoluble species; and (e) water washing the coal again to remove any residual acid.

10. The process of claim 9 wherein the preheating temperature is from about 420° C. to about 450° C.

11. The process of claim 9 wherein preheating occurs for from about ten minutes to about one hour.

12. The process of claim 11 wherein preheating is for from about 15 minutes to about 30 minutes.

13. The process of claim 9 wherein pretreating is in a sealed reactor vessel purged of oxygen.

14. The process of claim 13 wherein purging is inert gas purging.

15. The process of claim 14 wherein the inert gas purge is a nitrogen or steam purge.

16. The process of claim 14 wherein the inert gas purge is a steam purge.

17. A method of pretreating coal so that formation of carbonate during molten coal leaching is minimized, comprising:

(a) placing said coal in a reactor vessel from which air is excluded;

(b) heating the coal to a temperature of from about 420° C. to about 450° C. for from about 15 minutes to about 30 minutes.

18. The method of 17 wherein air is excluded by inert gas purging.

19. The method of claim 17 wherein air is excluded by nitrogen purging.

20. The method of claim 17 wherein air is excluded by steam purging.

21. The method of claim 17 wherein the carbonate formation in comparison with non-pretreated molten caustic leached coal is about 70%.

* * * * *